United States Patent [19]

England et al.

[11] Patent Number: 4,909,860

[45] Date of Patent: Mar. 20, 1990

[54] METHOD FOR STRENGTHENING COLD WORKED NICKEL-BASE ALLOYS

[75] Inventors: Jimmy C. England, Ashland, Ky.; Hugh H. Ruble, Jr.; Jon M. Poole, both of Huntington, W. Va.

[73] Assignee: Inco Alloys International, Inc., Huntington, W. Va.

[21] Appl. No.: 313,023

[22] Filed: Feb. 21, 1989

[51] Int. Cl.[4] ..... C22F 1/10

[52] U.S. Cl. ..... 148/11.5 N; 148/427

[58] Field of Search ..... 148/11.5 N, 426, 427

[56] References Cited

U.S. PATENT DOCUMENTS

| | | | |
|---|---|---|---|
| 3,767,385 | 10/1973 | Slaney | 75/122 |
| 4,358,511 | 11/1982 | Smith, Jr. et al. | 428/595 |
| 4,489,040 | 12/1984 | Asphahani et al. | 420/584 |
| 4,591,393 | 5/1986 | Kane et al. | 148/11.5 N |

OTHER PUBLICATIONS

Inco Alloys Intl. Inc., Inco Alloy G-3, 1986.
Inco Alloys Intl. Inc., Incoloy alloy 825, 1987.
Inco Alloys Intl., Inc., Inco alloy C-276, 1986.
Inco Alloys Intl. Inc., Incoloy alloy 925, 1983.

*Primary Examiner*—R. Dean
*Attorney, Agent, or Firm*—Edward A. Steen; Francis J. Mulligan, Jr.

[57] ABSTRACT

A heat treatment method for strengthening cold worked tubes made from nickel-base alloys without an attendant loss in corrosion resistance properties. Especially useful for tubes destined for energy resource recovery areas, oil fields, sour gas wells, etc., the tubes may be heated from 316°-769° C. (600°-1100° F.) for up to an hour.

4 Claims, 2 Drawing Sheets

METHOD FOR STRENGTHENING COLD WORKED NICKEL-BASE ALLOYS

TECHNICAL FIELD

The instant invention relates to nickel-base alloys in general and more particularly to a method for strengthening these alloys.

BACKGROUND ART

Oil country products are often subject to demanding conditions. In particular sour gas wells and certain oil fields certain highly corrosive actors and when combined with the elevated temperatures present wreak havoc with metallic members.

Accordingly, nickel-base alloys have been repeatedly selected for these demanding applications.

For example, INCO® alloys G-3 and C-276 and INCOLOY® alloy 825 (INCO and INCOLOY are trademarks of assignee) have been specified for use in deep sour gas wells and also for seamless pipes and liners in oil fields. For these applications the materials must meet stringent specifications dictating the acceptable range of room temperature tensile properties, hardness, macrostructure, microstructure and corrosion properties. Of particular interest to the energy companies is the room temperature 0.2% yield strength which is usually restricted to narrow ranges (i.e. 758.4–896.3 MPa [110–130 ksi], 861.9–999.7 MPa [125–145 ksi], 896.3–1034 MPa [130–150 ksi]).

INCO alloy G-3 is a nickel-chromium-iron alloy with additions of molybdenum and copper. It has good weldability and resistance to intergranular corrosion in the welded condition. The low carbon content helps prevent sensitization and consequent intergranular corrosion of weld heat-affected zones. It is most useful in corrosive environments. The nominal composition of alloy G-3 is about 21–23.5% chromium, 18–21% iron, 6–8% molybdenum, up to 5% cobalt, 1.5–2.5% copper, up to 1.5% tungsten, up to 1% silicon, up to 1% manganese, balance nickel, and traces of other elements.

INCO alloy C-276 is a nickel-molybdenum-chromium alloy with an addition of tungsten having excellent corrosion resistance in a wide range of severe environments. The molybdenum content makes the alloy especially resistant to pitting and crevice corrosion. The low carbon content minimizes carbide precipitation during welding to maintain corrosion resistance in as-welded structures. The nominal composition is about 15–17% molybdenum, 14.5–16.5% chromium, 4–7% iron, 3–4.5% tungsten, up to 2.5% cobalt, up to 1.0% manganese, balance nickel, and traces of other elements.

INCOLOY alloy 825 is a nickel-iron-chromium alloy with additions of molybdenum and copper. It has excellent resistance to both reducing and oxidizing acids, to stress corrosion cracking and to localized attack such as pitting and crevice corrosion. The nominal composition is about 19.5–23.5% chromium, 38–46% nickel, 2.5–3.5% molybdenum, 1.5–3% copper, 0.6–1.2% titanium, up to 1% manganese, at least 22% iron and traces of other elements.

Alloy 825, having an appreciable quantity of iron, has been heat treated by assignee in the past to strengthen tubes. By inserting the finally reduced tube into a salt bath having a temperature of about 482° C. (900° F.) for about one half hour, the resultant room temperature yield strength and tensile strength improved, on average about 5% and 7% respectively given an initial 150 ksi (1034.1 MPa) tensile strength and 130 ksi (896.2 MPa) yield strength.

There are differences in alloy G-3 and alloy 825 that do not permit straight expected comparisons. Besides different chemistries, alloy 825 forms a $M_{23}C_6$ phase, whereas alloy G-3 forms a $(Ni,CR,FE,CO)_3(Mo_1W)_2$ (mu) phase. These phase and chemistry differences result in different corrosion and work hardening behaviors.

A typical processing route for the manufacture of oil and gas field pipe is to produce a billet, extrude the billet to a tube, anneal the tube, reduce the tube, solution anneal the tube and subject the tube to a final tube reduction. The final tube reduction is performed with a controlled level of cold work to attain the desired yield strength. See FIG. 1 (solid lines). Unfortunately, for the alloys a prohibitively high level of cold work is necesary to reach the desired high yield strength levels. To overcome this limitation the annealing temperature can be reduced as the material's strength will increase as the anneal temperature decreases at a fixed level of cold work. However, this practice is limited by: (1) the precipitation of undesirable phases formed at lower temperatures; (2) the reduction of the material's corrosion resistance; and (3), in some cases, the reduction of room temperature ductility. Hence, it is desirable to define a processing method to increase the material's strength without sacrificing the other properties (i.e., corrosion resistance).

SUMMARY OF THE INVENTION

Accordingly, a strengthening method is provided without a loss in ductility or corrosion resistance. A 316°–769° C. (600°–1100° F.) thermal heat treatment after the final cold working operation is conducted for up to about an hour.

PREFERRED MODE FOR CARRYING OUT THE INVENTION

As alluded to above, tubes for oil and gas pipe may be made by producing a billet, extruding the billet to a tube, solution annealing the tube, reducing the tube, solution annealing the tube and finally reducing the tube to the desired diameter and wall thickness. The final reduction step puts cold work into the tube finalizing the physical and chemical properties of the tube.

Figure 2:
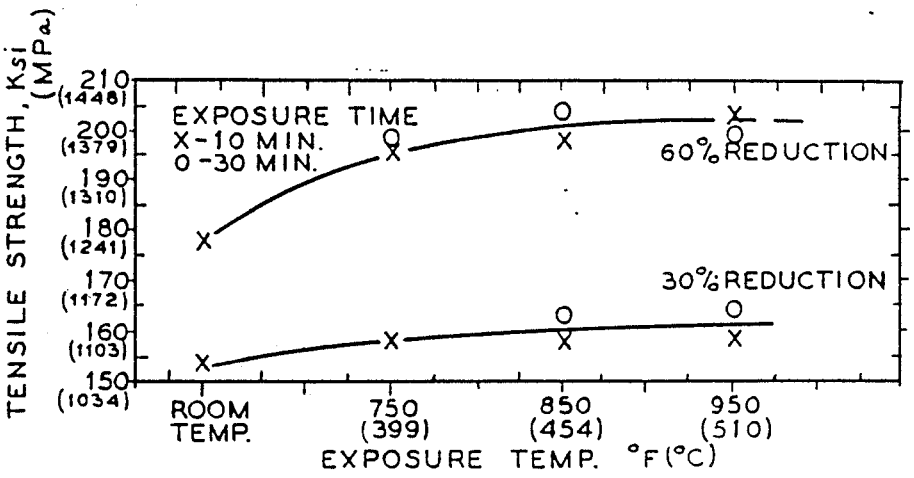
FIG. 2 is a graph plotting room temperature tensile strength v. exposure temperature.
Figure 3:
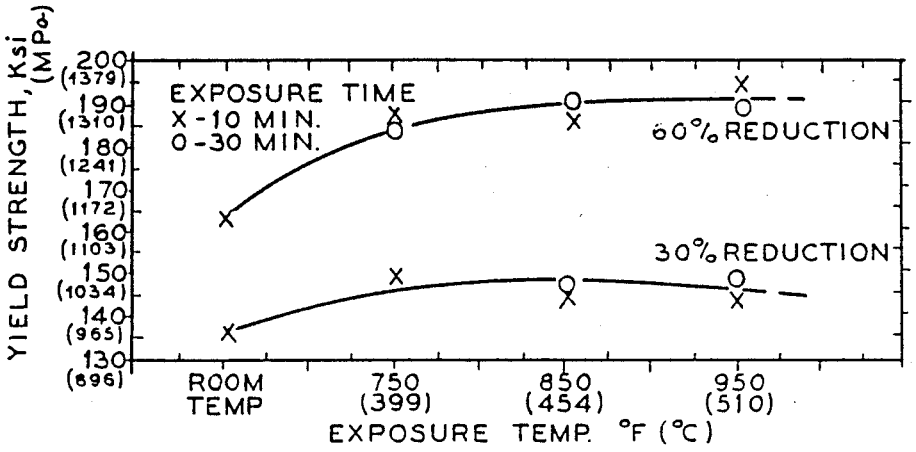
FIG. 3 is a graph plotting room temperature yield strength v. exposure temperature.

The strength of the tube may be enhanced without a significant loss in ductility or corrosion resistance. For nickel-base alloys having iron levels below about 22% this may be easily accomplished by generally employing a 316°–769° C. (600°–1100° F.) thermal treatment after the final cold working operation. See FIGS. 2 and 3. These two figures show the effect of exposure temperature on the room temperature tensile properties of alloy G-3.

The observed strength increase can range from about 0–207 MPa (0–30 ksi) with the magnitude of the increase dependent on the final cold reduction. It is generally independent of the exposure time, which can run from about five minutes to one hour. The strengthening heat treatment may be accomplished with standard means - furnace, molten bath, etc.

More particularly, it is preferred to treat a cold worked tube made from a nickel-base alloy having an iron content less than about 22%, such as say alloy G-3 at about 482.2° C. (900° F.)-510° C. (950° F.) for up to about 30 minutes. The resultant tube displays increased strength, vis-a-vis a similar non-treated cold worked tube, yet it retains the desired corrosion resistant characteristics. From experience with salt baths, a 482° C. (900° F.) heat treatment is most satisfactory.

Figure 1:
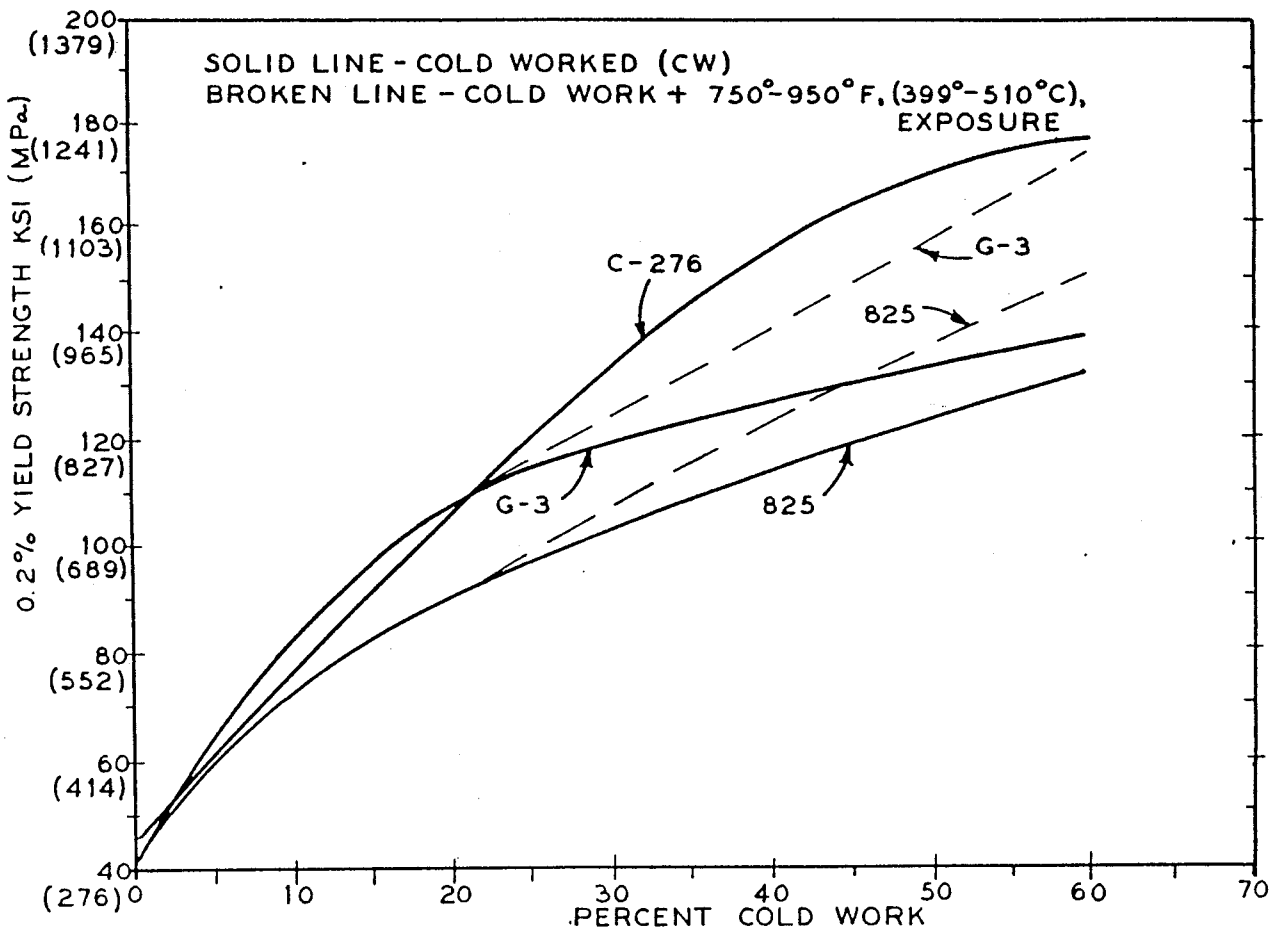
FIG. 1 is a work hardening curve plotting 0.2% yield strength v. percent cold work for the solution annealed alloys.

Although the inventors do not wish to be bound to the following explanation, the mechanism accounting for the strength increase is believed to be strain aging. This is a phenomenon where the solute atoms segregate to the high energy (Mo,W or C,N) dislocation positions in the alloy and restrict their movement (solute atmosphere). The macro effect is an observed strength increase. Further, since the Mo or W or C and N segregation is on an atomic scale and is in an uncombined form, this phenomenon does not invoke depletion of Mo and W or C and N which normally leads to a degradation in corrosion resistance. Hence, the material's strength is enhanced without loss in corrosion resistance and with moderate cold work levels (generally about 20% cold work). This is illustrated by the broken line curve in FIG. 1. Alloy C-276 is shown for comparison purposes.

While in accordance with the provisions of the statute, there is illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. Cold worked corrosion resistant nickel-base article of manufacture consisting essentially of about 21-23.5% chromium, about 18-21% iron, 6-8% molybdenum, up to about 5% cobalt, about 1.5-2.5% copper, up to about 1.5% tungsten, up to about 1% silicon, up to about 1% manganese, trace elements, and the balance nickel, characterized by increased article strength obtained by subjecting the article to a post cold work heat treatment of about 600°-1100° F. (316°-769° C.) from about five minutes to about one hour.

2. The invention according to claim 1 wherein the article is heat treated at about 900°-950° F. (482.2°-510° C.).

3. The invention according to claim 1 wherein the article is heat treated at about 900° F. (482.2° C.) for up to about one half hour.

4. A method for producing a tubular article, the method comprising producing a billet consisting essentially of about 21-23.5% chromium, about 18-21% iron, 6-8% molybdenum, up to about 5% cobalt, about 1.5-2.5% copper, up to about 1.5% tungsten, up to about 1% silicon, up to about 1% manganese, trace elements, and the balance nickel, forming a tube from the billet, thermally treating the tube, cold working the tube to predetermined dimensions, and heat treating the cold worked tube at about 600°-1100° F. (316°-769° C.) from about five minutes to about an hour.

* * * * *